US006971922B2

(12) United States Patent
Shimizu et al.

(10) Patent No.: US 6,971,922 B2
(45) Date of Patent: Dec. 6, 2005

(54) ELECTRIC CONNECTOR

(75) Inventors: Kazuomi Shimizu, Aichi (JP); Akihiko Onchi, Aichi (JP); Daisuke Miyachi, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/016,839

(22) Filed: Dec. 21, 2004

(65) Prior Publication Data

US 2005/0186855 A1 Aug. 25, 2005

(30) Foreign Application Priority Data

Dec. 26, 2003 (JP) ..... 2003-434949

(51) Int. Cl.[7] ..... H01R 24/00
(52) U.S. Cl. ..... 439/682; 439/74
(58) Field of Search ..... 439/682, 346, 439/74, 660

(56) References Cited

U.S. PATENT DOCUMENTS 5,277,597 A * 1/1994 Masami et al. ..... 439/83
5,931,689 A 8/1999 Patel
6,257,900 B1 7/2001 Huang et al.
6,328,606 B1 * 12/2001 Davis et al. ..... 439/660
6,908,345 B2 * 6/2005 Shimizu et al. ..... 439/682

FOREIGN PATENT DOCUMENTS

JP 2000-82519 A 3/2000
WO WO-97/45896 A1 12/1997

OTHER PUBLICATIONS

International Search Report mailed on Mar. 15, 2005.

* cited by examiner

*Primary Examiner*—Briggitte R. Hammond
(74) *Attorney, Agent, or Firm*—Rader, Fishman & Grauer PLLC

(57) ABSTRACT

An electric connector comprises a base connector fitted to a surface of a circuit board and a socket connector connected to ends of wires. The base connector includes a base housing having a mounting surface and two rows of base contacts. The socket connector includes a socket housing to be fitted to the base housing in a predetermined fitting direction perpendicular to the mounting surface, and two rows of socket contacts. Each of the base contacts has a fork-like shape including semi-fixed piece portion and a resilient piece portion. The resilient piece portion of each base contact is restrained from displacing by an intermediate wall of the base housing. The semi-fixed piece portion of each base contact is received by a side wall of the base housing.

7 Claims, 6 Drawing Sheets

ELECTRIC CONNECTOR

BACKGROUND OF THE INVENTION

1. Field of the Invention

The present invention relates to an electric connector for connecting a surface of a circuit board and for example, a flexible wiring to each other.

2. Description of Related Art

An electric connector of this kind is referred to as a board-to-wire (B to W: board to wire) type electric connector. Board-to-wire type connectors include so-called a vertical connector in which a socket connector is inserted into a base connector packaged on a surface of the circuit board in a direction perpendicular to the surface of the circuit board.

Further, recently, a connector of such a kind has been thinned and minimized (for example, arrangement pitch of contacts being not more than 1 mm) and at the same time made to have multiple poles, for example, 20, 30 or 40 poles thereby to make a housing of the connector large. If a long connector receives a twist by a force of the longitudinal direction, the contact pressure between the contacts are apt to become unstable.

On the other hand, an electric connector has been proposed in Japanese Unexamined Patent Publication No. 2000-82519 on Mar. 21, 2000. In this electric connector, both of a socket connector and a base connector are resiliently deformable.

When the socket connector is pulled out from the base connector, it is sometimes pulled out with pulling wires connected to the socket connector. In this case, a vertical electric connector of the abovementioned type is easily twisted. And therefore, such a vertical connector has a disadvantage that if it is twisted, the contact pressure between the contacts becomes unstable.

An object of the present invention is to provide an electric connector having rigidity against a twist.

SUMMARY OF THE INVENTION

For achieving the abovementioned object, the present invention provides, in a preferred embodiment, an electric connector comprising a base connector and a socket connector. The electric connector comprises a base connector and a socket connector. The base connector includes a base housing having a mounting surface for a surface of the board and base contacts arranged in two rows in the longitudinal direction of the base housing and held by the base housing in this state. The socket connector includes a socket housing connected to ends of wires and adapted to be fitted to the base housing in a predetermined fitting direction perpendicular to the abovementioned mounting surface, and socket contacts arranged in two rows and held by the socket housing in this state. Each socket contact includes a main part and a resilient tongue piece folded back from the main part. Each base contact has a semi-fixed piece portion and a resilient piece portion which contact the main part and the resilient tongue piece of the corresponding socket contact respectively, and each base contact has a fork-like shape capable of holding the main part and the resilient tongue piece of the socket contact together. The base housing includes a bottom wall, an opposed pair of side walls extending along the bottom wall and an intermediate wall extending from the bottom wall in parallel with the pair of side walls. The above mentioned mounting surface is provided on the bottom surface. In the abovementioned two rows of base contacts, the resilient piece portions thereof are disposed inside and the semi-fixed piece portions thereof are disposed outside respectively in the lateral direction of the base housing perpendicular to the abovementioned longitudinal direction thereof. The resilient piece portion of each base contact is restrained from displacing by the intermediate wall of the base housing. The semi-fixed piece portion of each base contact is received by the corresponding side wall of the base housing.

In this embodiment, a double (having two rows of contacts) vertical connector for board-to-wire has such a structure that the fork-like base contacts resiliently hold the socket contacts each having a resilient tongue piece (so-called bellows) respectively in the lateral direction of the base housing. As a result, if the connector is twisted by a force in the abovementioned lateral direction, a sufficient contact pressure can be ensured between the base contact and the socket contact.

Further, if the connector is twisted by a force in the longitudinal direction (so-called pitch twist, pitching twist), the contact pressure between the base contact and the socket contact are hardly influenced thereby.

In addition, since the resilient piece portions of one row of the fork-like base contacts are received by the intermediate wall while the other rows of the base contacts are received by the side wall of the base housing, the connector has rigidity against a twist caused by a force in the abovementioned lateral direction.

Furthermore, since both of the base contacts and the socket contacts have resiliency, a sufficient amount of resilient deformation can be ensured at the connecting time, so that an operator can sense a strong click (touch of connection achievement) in the connecting operation. Especially, since the contacts are formed of metal, an operator can sense a stronger click in the connecting operation than a click made between both resin members.

DETAILED DESCRIPTION OF THE PREFERRED EMBODIMENTS

A preferred embodiment of the present invention will be now described with reference to the appended drawings.

Figure 1:
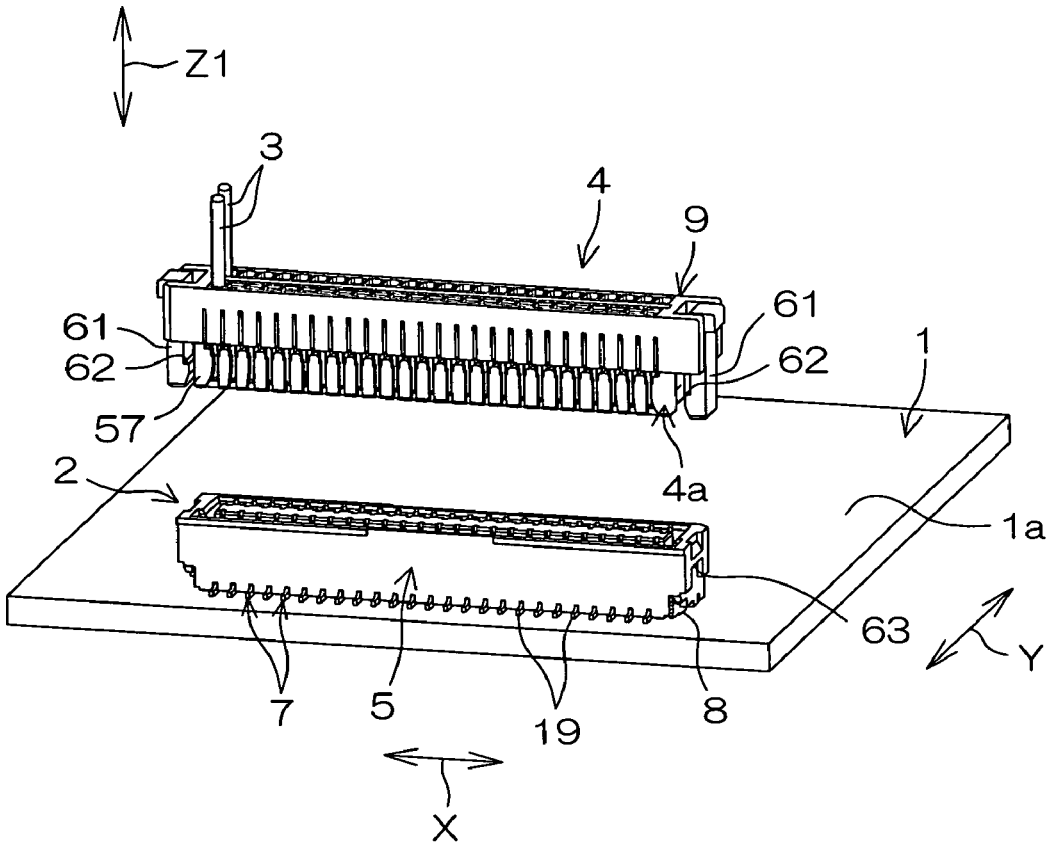
FIG. 1 is a schematical exploded perspective view of a base connector and a socket connector constituting an electric connector according to an embodiment of the present invention.
Figure 2:
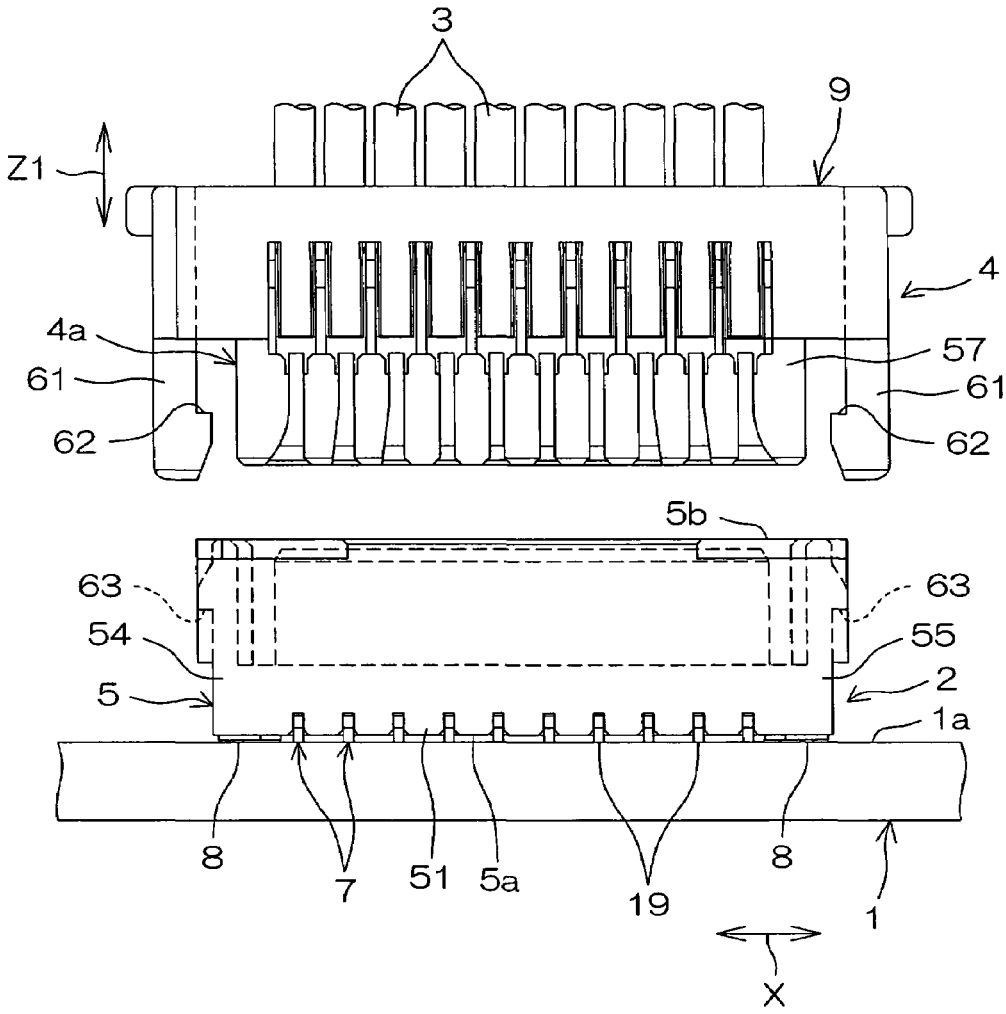
FIG. 2 is a schematical exploded side view of the base connector and the socket connector.
Figure 5:
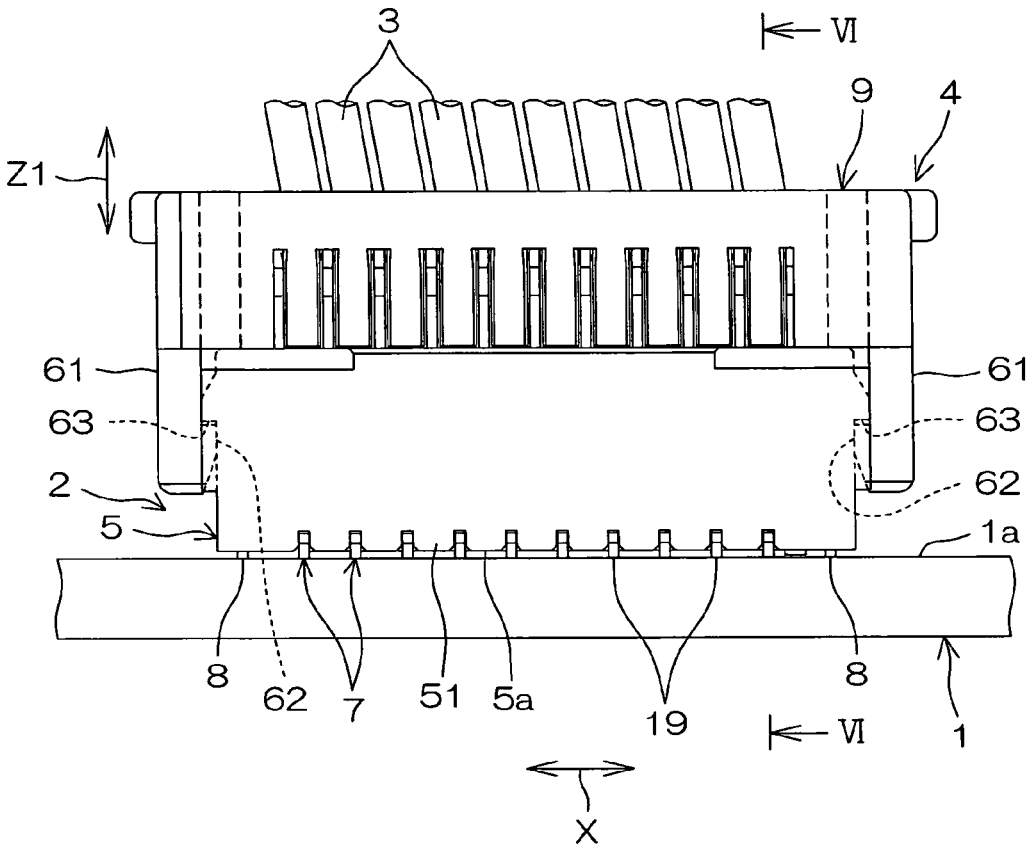
FIG. 5 is a side view of the base connector and the socket connector in the connected state.

FIG. 1 is a schematical exploded perspective view of an electric connector according to an embodiment of the present invention and FIG. 2 is a schematical exploded side view thereof. Referring to FIGS. 1 and 2, the connector of the present invention comprises a base connector 2 to be packaged on the surface 1*a* of a board 1 and a socket connector 4 to be connected to the end of a wire 3 in the connectable fashion. In FIGS. 2 and 5, a reduced number of poles of the connector are shown for simplification.

The base connector 2 comprises a horizontally elongated base housing 5 having a bottom surface 5*a* serving as a mounting surface for the surface 1*a* of the board 1, and a plurality of base contacts 7 (see FIG. 3) held by the base housing 5. Each base contact 7 includes a lead portion 19 to be soldered to a conductive member (not shown) on the surface 1*a* of the board 1.

Figure 3:
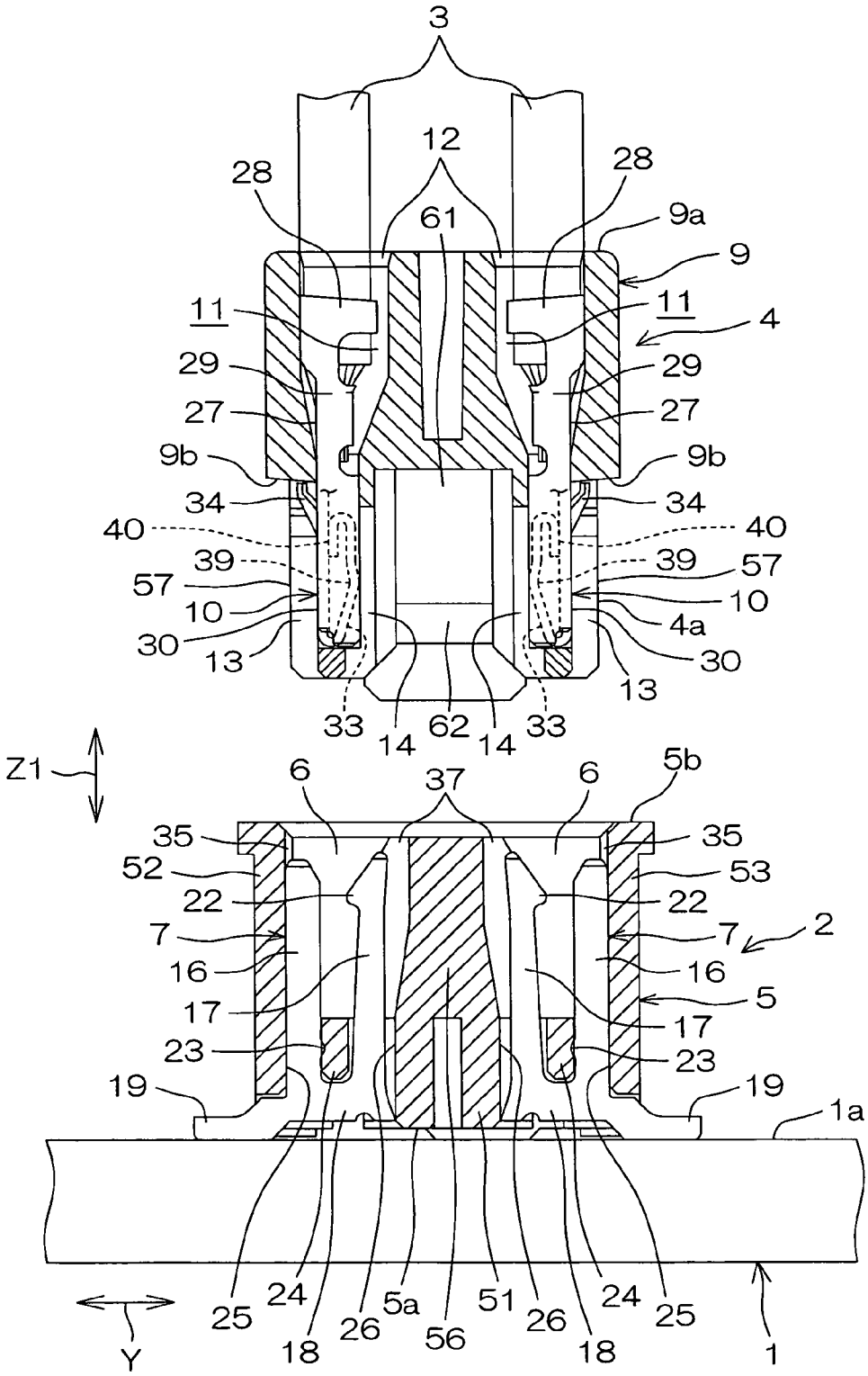
FIG. 3 is an exploded sectional view of the base connector and the socket connector.

Referring to FIGS. 1, 2 and 3, the socket connector 4 comprises a socket housing 9 having a pair of insertion projections 57 in a front half part 4*a* of the socket connector 4, and a plurality of socket contacts 10 (see FIG. 3) held by the socket housing 9.

Referring to FIGS. 1 and 2, tiltable cantilever resilient arms 61 are provided at the right and left end portions of the socket housing 9, and locking hooks 62 of the housing 9 are provided at the distal ends of resilient arms 6. On the other hand, stepped engagement portions 63 engageable with the corresponding hooks 62 are provided at the right and left end portions of the base housing 5. As shown in FIG. 5, by the engagement of the hooks 62 with respective corresponding engagement portions 63, the socket housing 9 can be prevented from being pulled out from the base housing 5.

The base housing 5 is rectangular in plan view as shown in FIG. 1 and is provided with a bottom wall 51 including the abovementioned bottom surface 5*a* as a mounting surface as shown in FIGS. 2 and 3. The base housing 5 is provided with an opposed pair of side walls 52, 53 (see FIG. 3) and an opposed pair of end walls 54, 55 (see FIG. 2) surrounding the four sides of the bottom wall 51, and is further provided with an intermediate wall 56 extending from the bottom wall 51 in parallel with the pair of side walls 52, 53 (see FIG. 3). The pair of side walls 52, 53 are long walls elongated along the bottom wall 51, while the pair of end walls 54, 55 are short walls.

Referring to FIG. 3, the base housing 5 has a pair of insertion recesses 6 into which the pair of insertion projections 57 provided in the front half part 4*a* of the socket connector 4 are inserted in a predetermined fitting direction Z1 perpendicular to the bottom surface 5*a* as a mounting surface. The pair of insertion recesses 6 are elongated in parallel with the longitudinal direction X of the base housing 5 (direction perpendicular to the paper surface in FIG. 3) and are defined between the intermediate wall 56 and the corresponding side walls 52, 53 respectively. The pair of insertion recesses 6 are opened at a connection end surface 5*b* of the base housing 5 and wholly contain aligned plurality of fork-shaped base contacts 7 respectively to hold these two rows of base contacts 7.

The lead portion provided at one end of each base contact 7 protrudes toward each side of the base housing 5 and is soldered to the conductive member on the surface 1*a* of the board 1 as mentioned above. Referring to FIGS. 1 and 2, metal fixtures 8 fitted into channels (not shown) at both ends of the longitudinal direction X of the base housing 5 respectively are soldered to the conductive members on the surface 1*a* of the board 1 to prevent the base connector 2 from being twisted or the like.

Referring to FIG. 3, the socket housing 9, which is a housing for the socket connector 4, contains two rows of aligned socket contacts 10 and each of the socket contacts 10 is contained in a corresponding socket contact containing room 11. The socket contact 10 is one to which one end portion of the wire 3 is, for example, pressure-attached (or pressure-contacted). The end portion of the wire 3 connected to the socket contact 10 by pressure-attachment is led through each opening 12 of a rear surface 9*a* of the socket housing 9 into the corresponding socket contact containing room 11.

At the pair of the insertion projections 57 of the front half part 4*a* of the socket connector 4, the socket housing 9 defines open portions 13, 14 which outwardly and inwardly open the socket contact containing room 11. Apart of the socket contact 10 opens to the outside through the open portions 13, 14.

The base contact 7 has a fork-like shape comprising a semi-fixed piece portion 16 and a resilient piece portion 17 and is formed, for example, by punting from a metal plate. In the two rows of the base contacts 7, the resilient piece portions 17 thereof are disposed inside and the semi-fixed piece portions 16 thereof are disposed outside respectively. The resilient piece portions 17 of the two rows of the base contacts 7 are restrained from being resiliently deformed excessively beyond a predetermined amount by their contacting the intermediate wall 56.

The base contact 7 has a connection portion 18 connecting the basic end portions of the semi-fixed piece portion 16 and the resilient piece portion 17 to each other. Each of the abovementioned lead portions 19 extends from the connected portion between the connection portion 18 and the semi-fixed piece portion 16 each sideways of the base connectors 2 to form substantially L-shape.

The semi-fixed piece portion 16 and the resilient piece portion 17 are inserted into the insertion recess 6 through individual insertion holes 25, 26 respectively provided in an innermost wall 24 of the insertion recess 6. The semi-fixed piece portion 16 is disposed in such a manner that it is partly fitted into a guide channel 35 formed in the inside surface of the side walls 52, 53 of the base housing 5 defining the insertion recess 6.

The semi-fixed piece portion 16 is disposed in such a manner that it substantially contacts the bottom surface of the guide channel 35 (for example, there is provided a microscopic space between the semi-fixed piece portions 16 and the bottom surface of the guide channel 35, and the amount of the space is 20~50 $\mu$m) and it functions mainly as a positioning reinforcement piece. In other words, being resiliently deformable in a minute amount in the base housing 5, the semi-fixed piece portion 16 serves for absorbing errors within this range, and in addition, when it is deformed beyond this range, it contacts the bottom surface of the guide channel 35 thereby to prevent the whole electric connector from being deformed and twisted in cooperation with the base housing 5.

The resilient piece portion 17 is disposed in such a manner that it is partly fitted into a guide channel 37 formed in the side surface of the intermediate wall 56 defining the insertion recess 6. Since a sufficient space is provided between the resilient piece portion 17 and the bottom surface of the guide channel 37, the resilient piece portion 17 is resiliently deformable sideways. Therefore, the resilient piece portion 17 functions as a contact piece for securing the contact pressure with respect to a belowmentioned resilient tongue piece 33 of the corresponding socket contact 10. In addition, when the base housing 5 is much twisted, the resilient piece portion 17 contacts the bottom surface of the guide channel 37 to prevent the deformation of the electric connector.

At the distal end of the resilient piece portion 17, formed is a mountain-shaped projection 22 protruding in the direction crossing the abovementioned fitting direction Z1, namely, toward the semi-fixed piece portion 16. Further, at a portion near the basic end of the semi-fixed piece portion 16, formed is a bite type projection 23 biting into the innermost wall 24 so as to prevent pull-put of the base contact 7 and fix the same.

Figure 4:
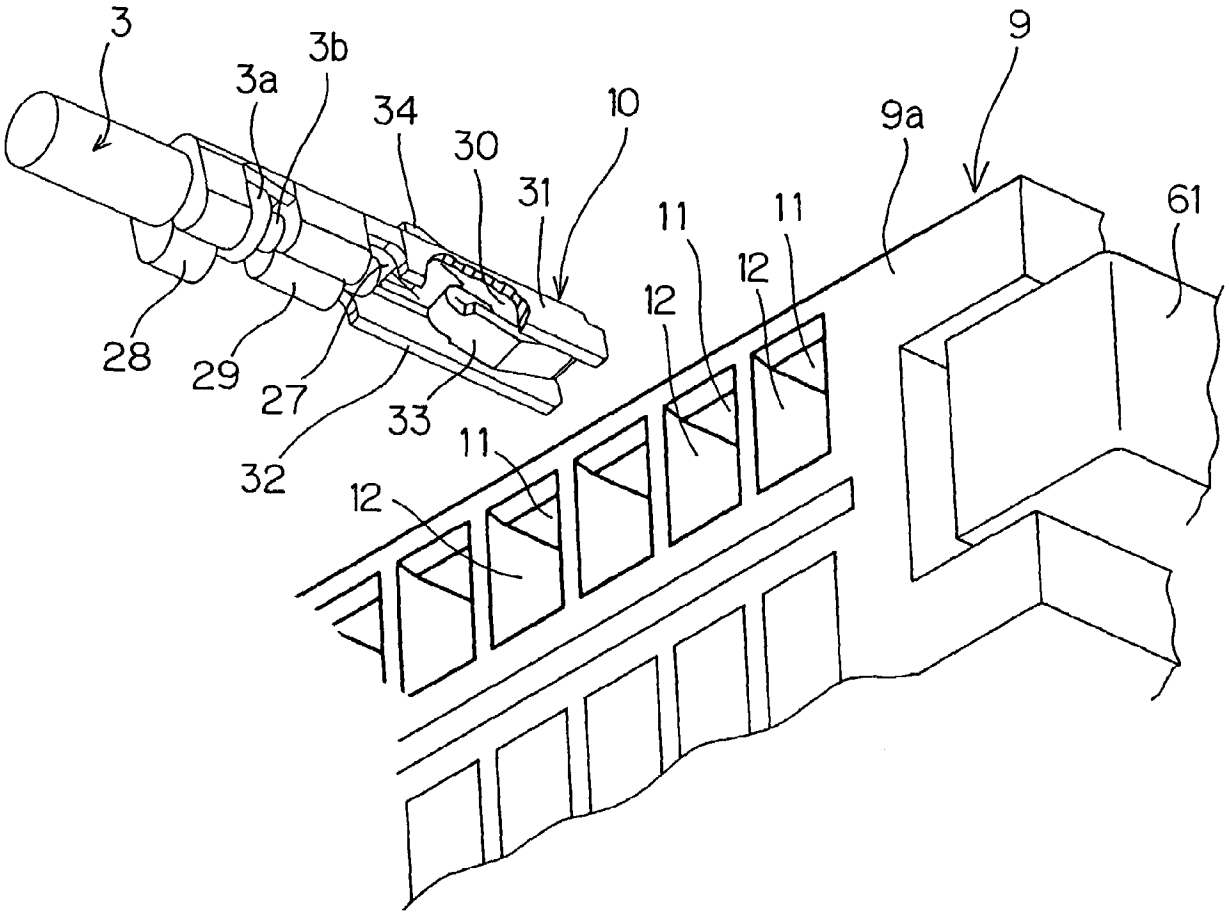
FIG. 4 is an exploded perspective view of a main part of the socket connector.

Now, referring to FIGS. 3 and 4, the socket contact 10 will be described. The socket contact 10 has a main part 27. At the rearmost portion of this main part 27, an insulation barrel 28 for clamping an insulation-coated portion 3*a* of the wire 3 is formed. And ahead of this insulation barrel 28, formed is a wire barrel 29 for clamping a core wire 3*b* of the wire 3. Referring to Fig. 4, the front half part of the main part 27 comprises a first section 30, and second and third sections 31, 32 disposed on both sides of the first section 30. These first, second and third sections 30, 31, 32 form a ⊐-shape in section.

Figure 6:
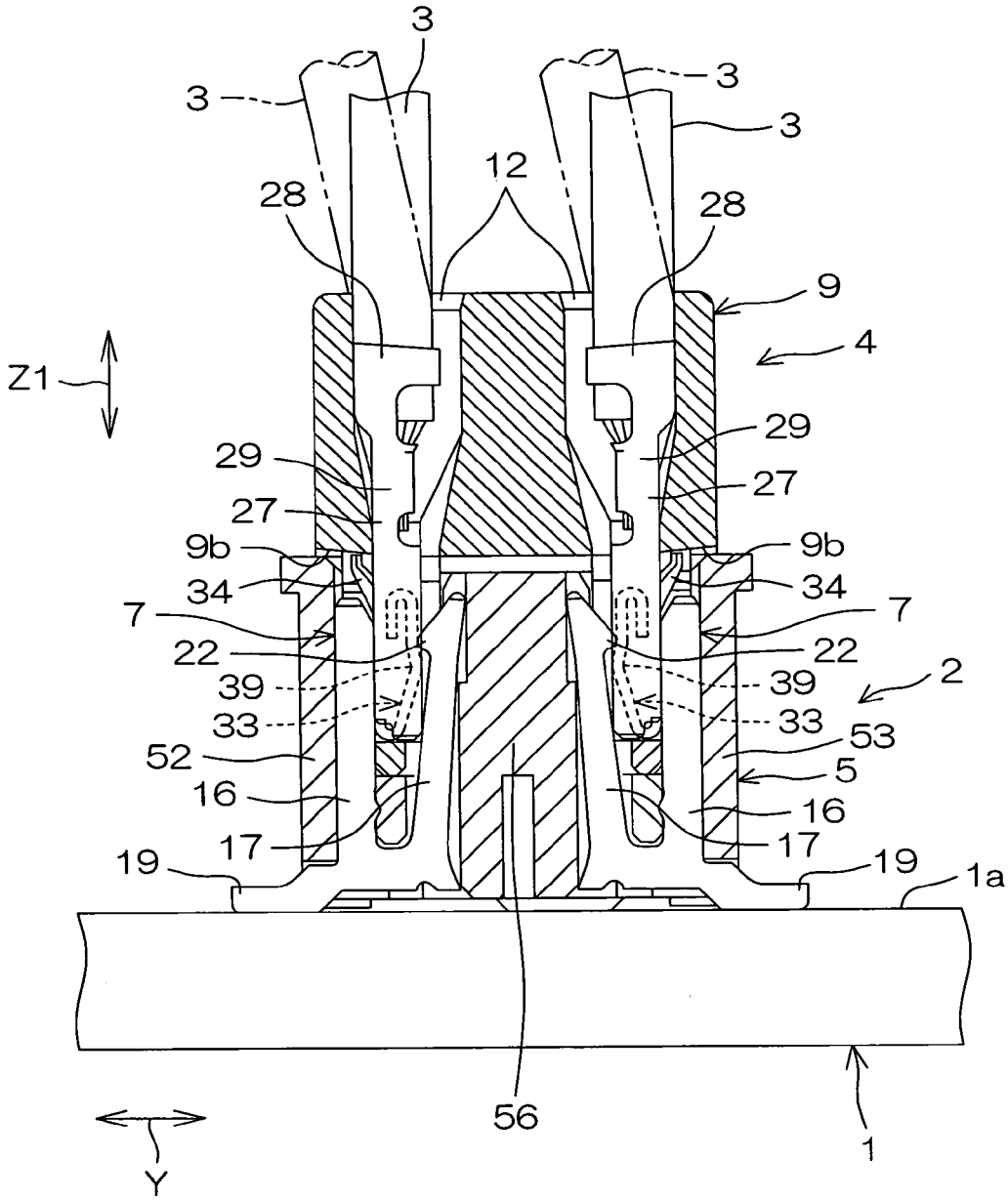
FIG. 6 is a sectional view along line VI—VI of FIG. 5.

A resilient tongue piece 33 is folded back from a distal end of the first section 30 of the front half part of the main part 27. Further, in the first section 30, a contact lance 34 comprising a cut and pulled-off projection is provided so as to protrude on the opposite side of the resilient tongue piece 33. As shown in FIG. 3, the contact lance 34 contacts a contact surface 9*b* comprising a stepped portion of the socket housing 9 thereby to serve for preventing pull-out of the socket contact 10. Further, the contact lance 34, which outwardly protrudes through the open portion 13, resiliently presses the inside surface of the side walls 52, 53 defining the insertion recess 6 of the corresponding base housing 5 when the base connector 2 and the socket connector 4 are in the connected state as shown in FIG. 6. Thereby, the contact lance 34 also functions as a housing lance.

The resilient tongue piece 33 has a mountain-shaped projection 39 protruding in a direction crossing the abovementioned predetermined fitting direction Z1 and engageable with the mountain-shaped projection 22 of the resilient piece portion 17. At the time of connecting the two contacts 7, 10, the two mountain-shaped projections 22, 39 ride across and come into engagement with the corresponding mountain-shaped projections 39, 22 respectively as shown in FIG. 6, so that a nice click is sensed by an operator in the connecting operation.

The distal end portion 40 of the resilient piece tongue piece 33 is folded back on the first portion 30 side. And when the resilient tongue piece 33 is in the free state, the distal end portion 40 thereof is substantially in close contact with the first portion 30 of the main part 27. As a result, the resilient tongue piece 33 is supported at both ends, so that the resilient repulsive force of the resilient tongue piece 33 increases and a strong contact pressure can be obtained between the resilient tongue piece 33 and the resilient piece portion 17 of the base contact 7. In addition, even if the socket connector 4 is frequently inserted and pulled out, the resilient tongue piece 33 has an improved tolerance.

According to this embodiment, so-called a board-to-wire and double (including two rows of contacts) vertical connector has such a structure that the fork-like base contact 7 resiliently holds the corresponding socket contact 10 therebetween in the lateral direction Y of the base housing 5, and therefore, if the wire 3 is obliquely pulled and twisted by a force in the abovementioned lateral direction Y as shown in two-dot-and-chain line in FIG. 6, a sufficient contact pressure can be ensured between the contacts 7, 10.

Further, when the connector is twisted by a force in the abovementioned lateral direction Y as shown in FIG. 6, the resilient piece portion 17 of the fork-like base contact 7 in one row is received by the intermediate wall 56 of the base housing 5 while the semi-fixed piece portion 16 of the base contact 7 in the other row is received by the side wall 52 or 53 of the base housing 5, so that the connector can be reinforced against a twist by a force in the abovementioned lateral direction Y.

Especially at the time of connecting the connectors 2, 4, the main part 27 of the socket contact 10 is received through the semi-fixed piece portion 16 of the base contact 7 by the inside surface of the side walls 52, 53 of the base housing 5, and therefore, the connectors 2, 4 can be restrained from being twisted in the lateral direction without causing any trouble by the formation of the open portion 13.

Further, since the connector has such a structure that the base contact 7 resiliently holds the socket contact 10 in the lateral direction Y as abovementioned, the contact pressure between the two contacts 7, 10 is hardly influenced if the wires 3 are obliquely pulled as shown in FIG. 5 and the contacts 7, 10 receive twist (pitch twist, pitching twist) by a force of the longitudinal direction X.

Further, by engaging the hook 62 of the socket connector 4 with the engagement portion 63 of the base connector 2, both of the housings 5, 9 are locked at their longitudinal ends, so that so-called pitch twist itself hardly occurs.

Further, since both of the contacts 7, 10 have resiliency, a sufficient amount of resilient deformation can be ensured at the connecting time, so that the operator can sense a strong click (touch of connection achievement) in the connecting operation. Especially, since both of the contacts 7, 10 are formed of metal, a stronger click can be sensed in the connecting operation than a click made between both resin members.

Further, since the respective mountain-shaped projections 22, 39 of both of the contacts 7, 10 are engaged with each other, the contacts 7, 10 are hardly pulled out. Furthermore, at the time of connecting the contacts 7, 10 to each other, a preferable click can be obtained by the riding action of the mountain-shaped projections 22, 39 across each other.

The present invention is not limited to the abovementioned embodiment but, for example, the open portion 13 can be omitted and in this case, a high strength can be achieved though the width become a little larger. Furthermore, the resilient piece portion 16 in the free state may be adapted to contact the bottom surface of the guide channel 35.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

The present application corresponds to Japanese Patent Application No. 2000-434949 filed with the Japan Patent Office on Dec. 26, 2003, the disclosure of which is incorporated hereinto by reference.

What is claimed is:

1. An electric connector comprising a base connector and a socket connector, the base connector including a base housing having a mounting surface for a surface of a circuit board and two rows of base contacts arranged in a longitudinal direction of the base housing and held by the base housing, the socket connector including a socket housing connected to ends of wires and adapted to be fitted to the base housing in a predetermined fitting direction perpendicular to the mounting surface, and socket contacts arranged in two rows and held by the socket housing, each socket contact including a main part and a resilient tongue piece folded from the main part, each base contact having a semi-fixed piece portion and a resilient piece portion which respectively contact the main part and the resilient tongue piece of a corresponding socket contact, and each base contacts having a fork shape capable of holding the main part and the resilient tongue piece of the socket contact together, the base housing including a bottom wall, an opposed pair of side walls extending along the bottom wall and an intermediate wall extending from the bottom wall in parallel with the pair of side walls, the mounting surface being provided on the bottom surface, in the two rows of base contacts, the resilient piece portions thereof being disposed inside and the semi-fixed piece portions thereof being disposed outside respectively both in the lateral direction of the base housing perpendicular to the said longitudinal direction thereof, the resilient piece portion of each base contact being restrained from displacing by the intermediate wall of the base housing, and the semi-fixed piece portion of each base contact being received by a corresponding side wall of the base housing.

2. The electric connector according to claim 1;

wherein a space is provided between the semi-fixed piece portion of each base contact in a state when it is not connected to the corresponding socket contact and the corresponding side wall;

wherein an amount of the space is 20~$\mu$m; and wherein the semi-fixed piece portion is resiliently deformable with a displacement amount corresponding to the amount of the space.

3. The electric connector according to claim 1;

wherein the resilient tongue piece and the resilient piece portion respectively have mountain-shaped projections oppositely protruded in a direction crossing the predetermined fitting direction; and wherein the mountain-shaped projections of the resilient tongue piece and the resilient piece portion ride across and come into engagement with the mountain-shaped projections respectively at a time of connecting the base contact and the socket contact.

4. The electric connector according to claim 1;

wherein the resilient tongue piece has a distal end portion; and wherein the distal end portion of the resilient tongue piece of the socket contact in a state when it is not engaged with the base contact is in contact with the main part.

5. The electric connector according to claim 1;

wherein the main part of each socket contact is formed in a channel-like shape having a first section connected to the resilient tongue piece and second and third sections respectively disposed on both sides of the resilient tongue piece with the resilient tongue piece interposed therebetween.

6. The electric connector according to claim 1;

wherein the base housing includes a pair of end portions having a pair of engagement portions respectively; and wherein the socket housing includes a pair of locking hooks engageable with the pair of the engagement potions of the base housing when the base housing and the socket housing are connected to each other.

7. The electric connector according to claim 1;

wherein each contact containing room has an open portion allowing the main part of the socket contact to open to the outside; and wherein the main part of each socket contact is received through the semi-fixed piece portion by a wall surface of a corresponding side wall.

* * * * *